US008387242B2

(12) United States Patent
Lee et al.

(10) Patent No.: US 8,387,242 B2
(45) Date of Patent: Mar. 5, 2013

(54) MANUFACTURING METHOD OF AN ELECTRICAL CONNECTOR

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 73 days.

(21) Appl. No.: 13/037,606

(22) Filed: Mar. 1, 2011

(65) Prior Publication Data

US 2011/0146897 A1 Jun. 23, 2011

Related U.S. Application Data

(60) Division of application No. 12/831,398, filed on Jul. 7, 2010, now Pat. No. 7,914,301, and a continuation-in-part of application No. 12/367,737, filed on Feb. 9, 2009, now abandoned.

(30) Foreign Application Priority Data

Dec. 26, 2008 (TW) ..... 97223331 U

(51) Int. Cl.
*H01R 43/02* (2006.01)

(52) U.S. Cl. ..... 29/877; 29/874; 29/876; 439/77

(58) Field of Classification Search ..... 29/874, 29/876, 877; 439/77
See application file for complete search history.

(56) References Cited

U.S. PATENT DOCUMENTS 7,914,301 B2 * 3/2011 Lee et al. ..... 439/77

* cited by examiner

*Primary Examiner* — Carl Arbes
(74) *Attorney, Agent, or Firm* — Rosenberg, Klein & Lee

(57) ABSTRACT

An electrical connector includes a fixing member having a support seat; a plurality of terminals, each having an embed section embedded within the fixing member along an extension direction via an insert-molding process and a contact section exposing from the support seat of the fixing member; and an insulated body for seating on the support seat of the fixing member. The insulated body has an insert face formed with a plurality of terminal holes. The insert face is dented inwardly so as to form a plug reception chamber in spatial communication with the terminal holes. When the insulated body is seated on the support seat of the fixing member, the contact sections of the terminals pass through the terminal holes in the insulated body and are retained within the plug reception chamber.

3 Claims, 8 Drawing Sheets

MANUFACTURING METHOD OF AN ELECTRICAL CONNECTOR

This application is a divisional application of U.S. application Ser. No. 12/831,398, which was filed on Jul. 7, 2010, now pending, and is a CIP (Continuation In Part) of the application Ser. No. 12/367,737; titling "ELECTRICAL CONNECTOR", filed on 9 Feb. 2009.

BACKGROUND OF THE INVENTION

1. Field of the Invention

The present invention relates to an electrical connector, more particularly to an electrical connector including a plurality of terminals embedded partially within an insulated body via an insert-molding process.

2. Description of the Prior Art

Most of PCs (personal computer), TV sets and electronic devices have an outer casing provided with built-in electrical connector 100*a* for electrical connection to a peripheral device (such as DVD player) to facilitate signal transmission therebetween.

FIG. 1 shows a partly exploded view of a conventional electrical connector 100*a* to include an insulated body 110*a* and a plurality of terminals 120*a*. The insulated body 110*a* is made from dielectric materials and is formed with a plurality of retention holes 111*a*. Each terminal 120*a* has a contact section 121*a*, a securing section 122*a*, an extension section 123*a* and a mounting section 124*a*. After assembly, the contact and securing section 121*a*, 122*a* of the terminals 120*a* extend through the retention holes 111*a* in the insulated body 110, thereby exposing the extension sections 123*a* to an exterior of the insulated body 110*a* such that the electromagnetic wave interference (EMI) exists among the extension sections 123*a*. The presence of EMI may affect the signal transmission of the conventional electrical connector 100*a*.

In addition, during transportation or shifting of the conventional electrical connector 100*a* from one place to another, the mounting sections 124*a* being exposed from the insulated body 100*a* may collide against or entangle with a nearby object, thereby resulting in pulling the terminals 120*a* out from the insulated body 110*a* and causing damage of the conventional electrical connector 100*a*. Moreover, long time exposure of the extension sections 123*a* of the terminals 120*a* to an exterior of the insulated body 110*a* may cause oxidation thereto, which, in turn, decreases the aesthetic appearance of the conventional electrical connector 100, hence the disqualified product. It is difficult to sell out such ugly disqualified product, which must be discarded eventually.

In addition, the contact section 121*a*, the securing section 122*a*, the extension sections 123*a* in each terminal 120*a* are in bifurcation structure such that a lot of waste will be resulted since the terminals 120*a* are fabricated by punching and cutting an elongated metal plate along a longitudinal length thereof, which provides the maximum numbers of terminals in the longitudinal length. The waste resulting therefrom incurs extra manufacturing expense to the producers.

SUMMARY OF THE INVENTION

Therefore, the object of the present invention is to provide an electrical connector produced by an injection molding process and including a plurality of terminals partially embedded within an insulated body via an insert-molding process such that the terminals cannot be easily pulled out. In addition, the problem of oxidation at the exposed sections of the terminals as encountered in the prior art electrical connector can be avoided and simultaneously causing little waste when fabricating the terminals from an elongated metal plate.

The electrical connector according to the present invention includes a fixing structure and an insulated body.

The fixing structure includes a fixing member and a plurality of terminals. The fixing member has a support seat. Each terminal has an embed section embedded within the fixing member along an extension direction via an insert-molding process and a contact section extending from one end of the embed section and exposing to an exterior from the support seat of the fixing member.

The insulated body is to be seated on the support seat of the fixing member, and has an insert face formed with a plurality of terminal holes. The insert face is dented inwardly so as to form a plug reception chamber in spatial communication with the terminal holes. When the insulated body is seated on the support seat of the fixing member, the contact sections of the terminals respectively pass through the terminal holes in the insulated body and are retained within the plug reception chamber simultaneously.

A manufacturing method of the electrical connector according to the present invention includes the following steps. Installing and fixing a plurality of terminals in an insert-molding module. Injecting melting plastic material into the insert-molding module and the melting plastic material covers the embed sections of the terminals. Seating the insulated body on a support seat of the fixing member. Finally, heating the insert-molding module to make the contacted surface of the insulated body and the fixing member to be melted and thus combined with each other.

In the present invention, the embed sections of the terminals are embedded in the fixing member via the insert-molding process while the contact sections thereof extend through the terminal holes in the insulated body and are retained within the plug reception chamber. Therefore, no auxiliary fixing structure of the prior art is required in the present invention. The terminals of the present invention can be fabricated from an elongated metal plate by punching and bending operation without causing a relatively large waste. In addition, since the embed sections of the terminals are embedded securely within the fixing member, the terminals are prevented from being pulled out easily from the electrical connector of the present invention. Since only minor portions of the terminals are exposed to the exterior of the insulated body, the occurrence of oxidation problem and electromagnetic interference among the exposed section as encountered during use of the conventional electrical connector can be avoided.

Besides, the fixing structure and the insulated body are combined tightly or are formed integrally via the manufacturing method of the present invention.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
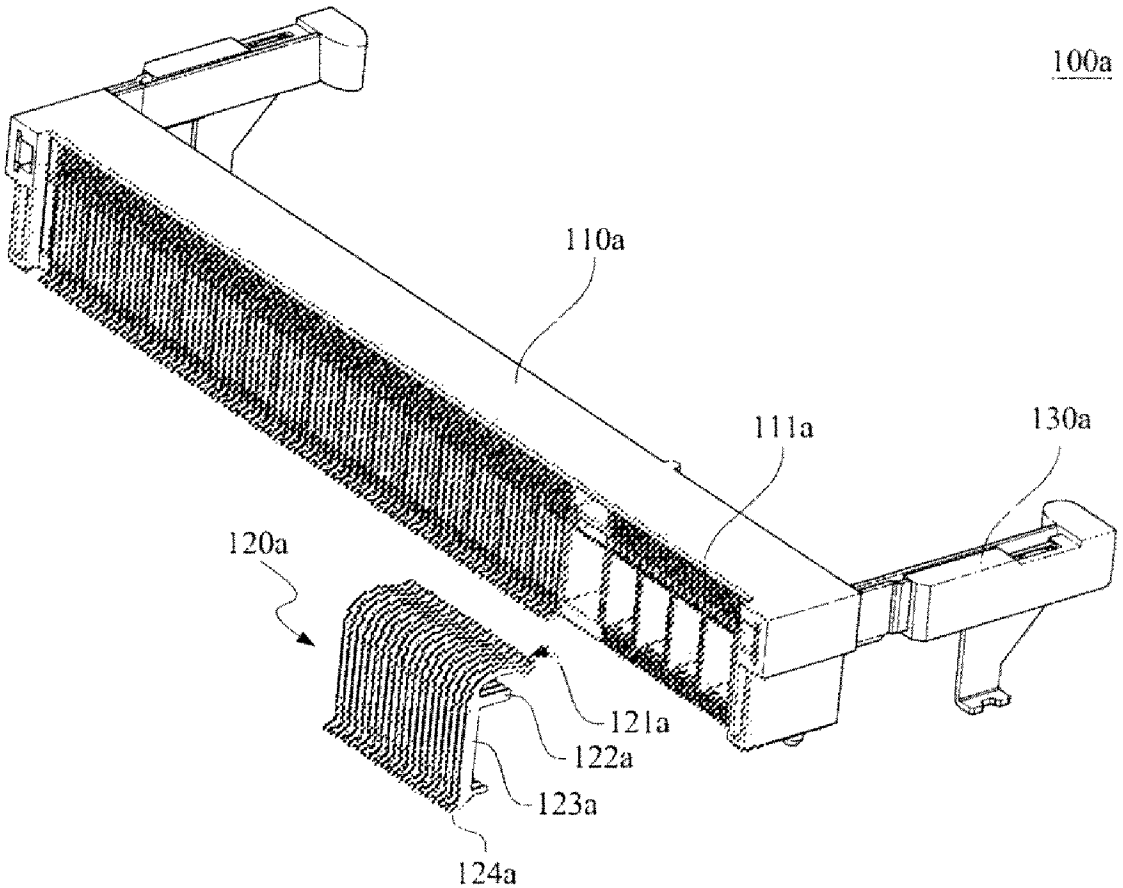
FIG.1(Prior Art)
FIG. 1 is a partly exploded and perspective view of a conventional electrical connector.
Figure 2:
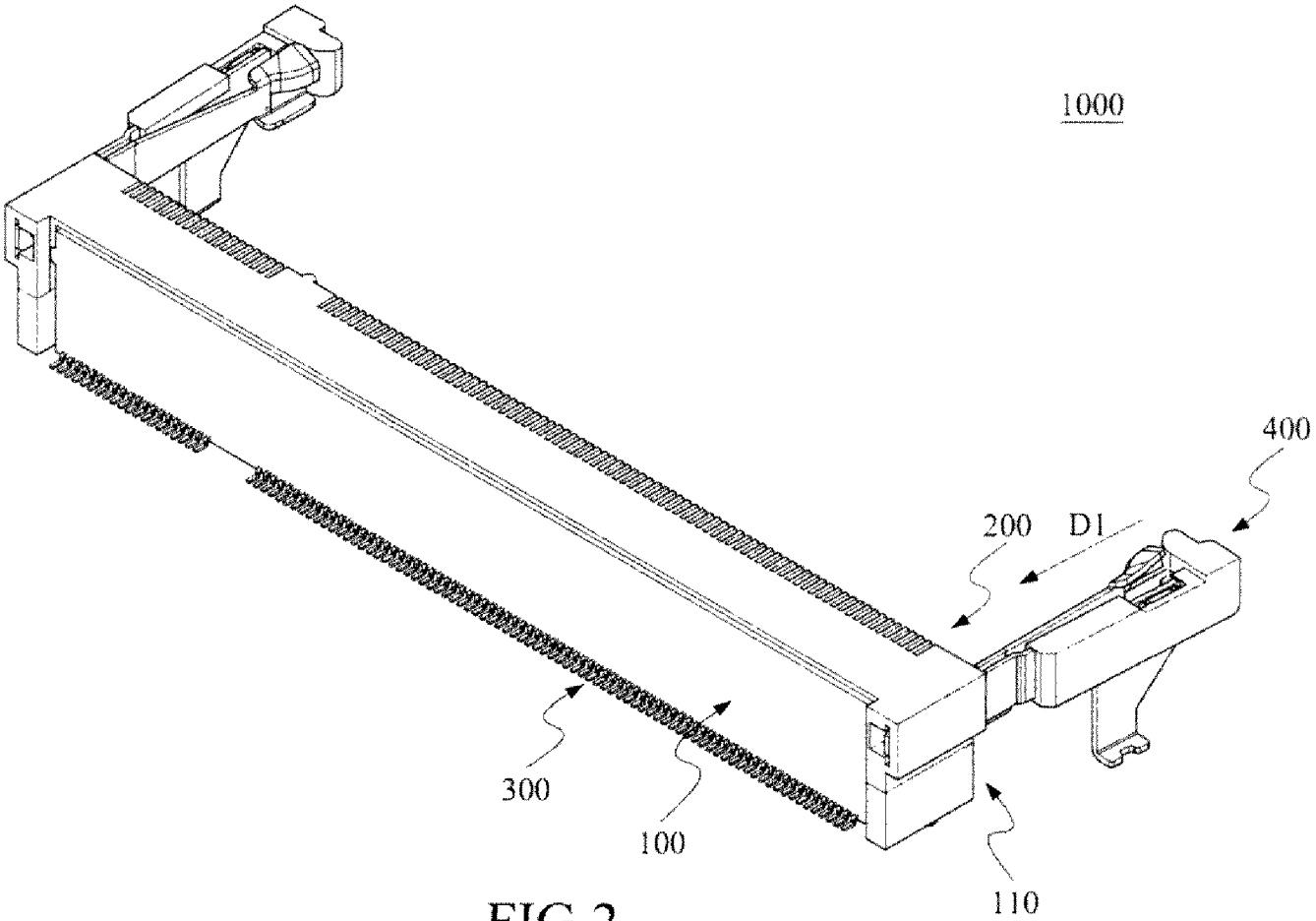
FIG. 2 is a perspective view of an electrical connector of the present invention.

FIG. 2 is a perspective view of an electrical connector 1000 of the present invention and includes a fixing structure 100, a coupling structure 200 and a pair of support members 400. The fixing structure 100 includes a fixing member 110 having a support seat 115 to support an object thereabove and a plurality of terminals 300. Each of the terminals 300 has a section partially embedded within the fixing member 110. The coupling structure 200 is disposed above the support seat 115 of the fixing member 110 or the fixing member 110 is coupled to the coupling structure 200 along an extension direction D2. The support members 400 are inserted respectively along a coupling direction D1 transverse to the extension direction D2 into two lateral sides of the coupling structure 200.

Figure 3:
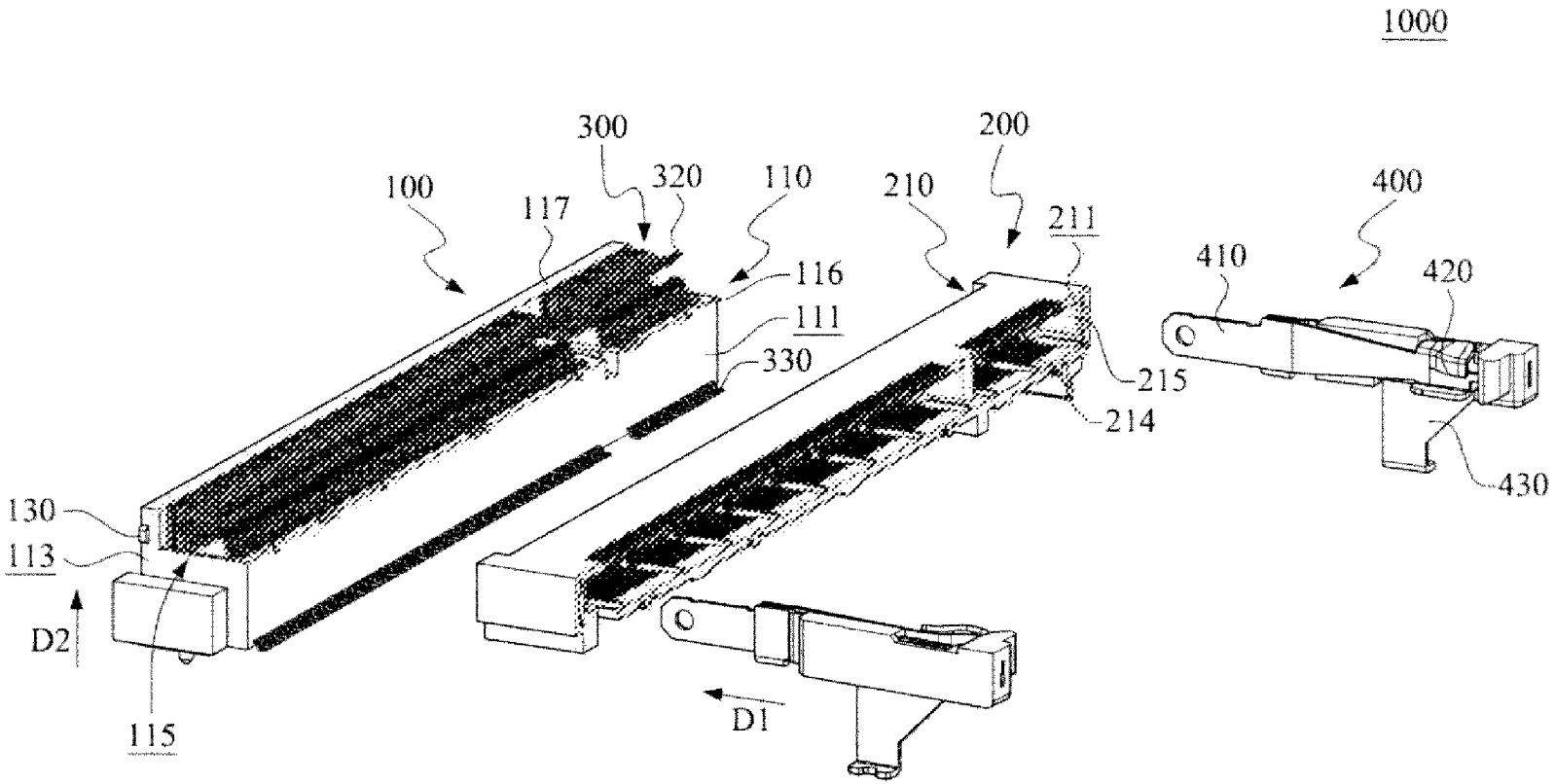
FIG. 3 is an exploded and perspective view of the electrical connector of the present invention.
Figure 4:
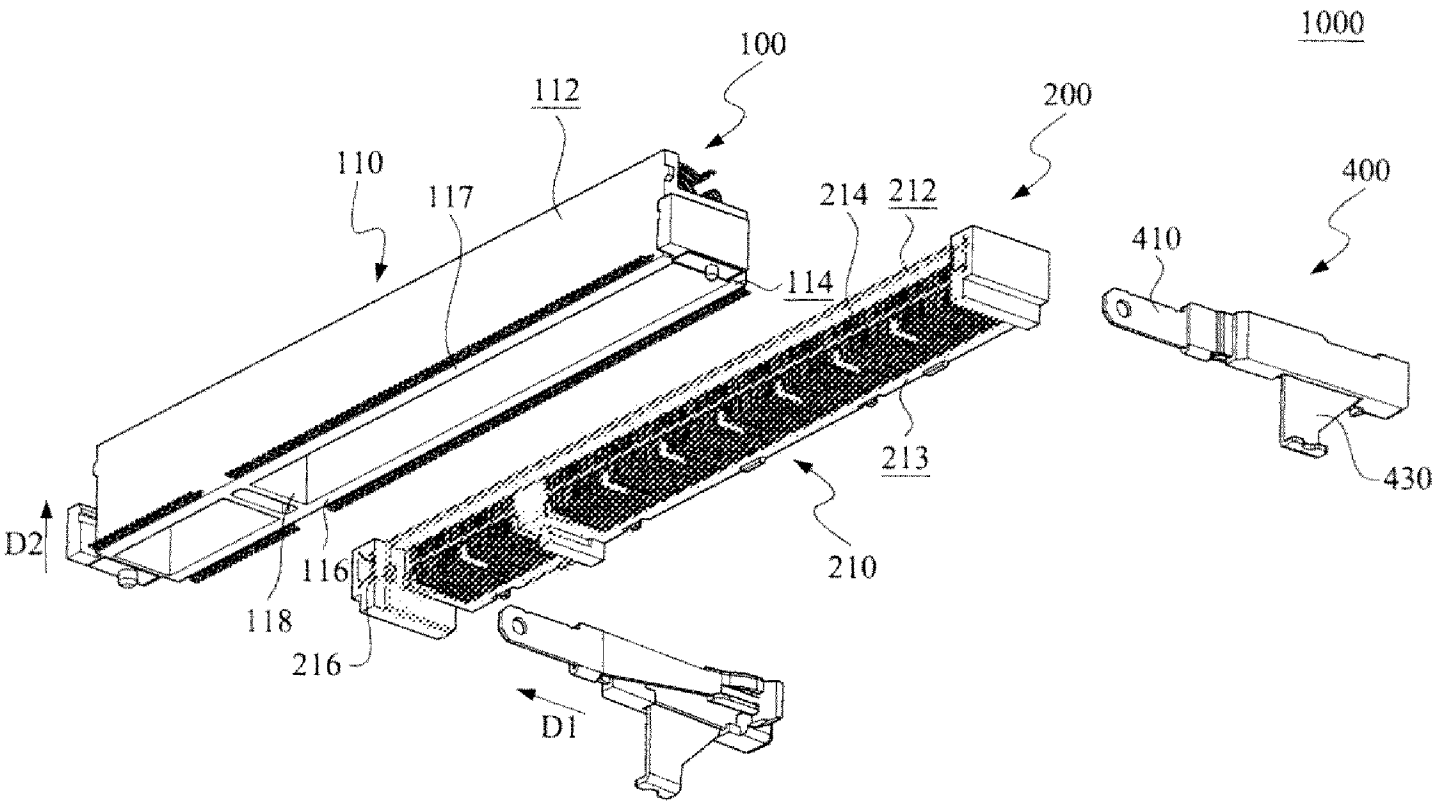
FIG. 4 is an exploded and perspective view of the electrical connector of the present invention from another angle.

Referring to FIGS. 3 and 4, wherein FIG. 3 is an exploded and perspective view of the electrical connector of the present invention and FIG. 4 is an exploded and perspective view of the electrical connector of the present invention from another angle. As illustrated, the fixing structure 100 includes a fixing member 110 and two retaining blocks 130 and a plurality of terminals 300.

The fixing member 110, generally rectangular, has a front end side 111, a rear end side 112 opposite to the front end side 111, two lateral sides 113 interconnecting the front and rear end sides 111, 112, and a bottom side 114 interconnecting the front and rear end sides 111, 112. The bottom side 114 of the fixing member 110 is to be mounted on a printed circuit board (not shown) or a mounting assembly.

The front end side 111 of the fixing member 110 is formed with a front embed portion 116 while the rear end side 112 thereof is formed with a rear embed portion 117. The fixing member 110 further has big and small extension holes 118 extending along the extension direction D2 and are located between the front and rear embed portions 116, 117. By forming the extension holes 118 at the bottom of the fixing member 110, a relative amount of the material can be economized during the production thereof.

The retaining blocks 130 are integrally formed with and extend outwardly from the lateral sides 113 of the fixing member 110, the purpose of which will be given in the following paragraphs.

The coupling structure 200 includes an insulated body 210 for seating on the support seat 115 of the fixing member 110, and has a front insert face 211, a rear insert face 212 opposite to the front insert face 211, a coupling bottom side 213, a plurality of terminal holes 214 and two retention recesses 216. The front insert face 211 is dented inwardly so as to form a plug reception chamber 215 for receiving a plug of an electrical connector (not shown) inserted from am exterior or a memory unit. In this embodiment, the plug reception chamber 215 is in spatial communication with the terminal holes 214 and the terminal holes 214 extend through the rear insert face 212 and the coupling bottom, side 213. The retention recesses 216 are formed at inner portions of the rear insert face 212 in such a manner to receive the retention blocks 130 respectively when the fixing member 110 is coupled to the insulated body 210 along the extension direction D2 (see FIG. 3), thereby enhancing the engagement between the fixing structure 100 and the coupling structure 200.

Figure 5:
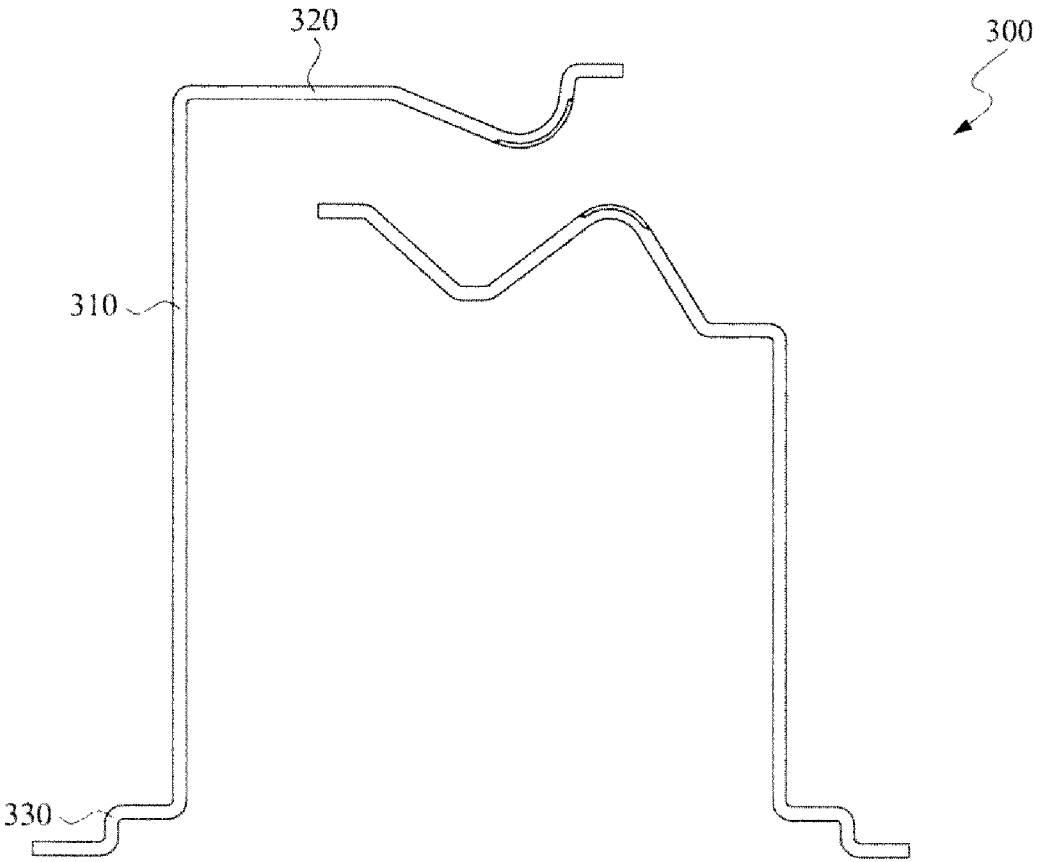
FIG. 5 shows two terminals employed in the electrical connector of the present invention.

FIG. 5 shows two terminals employed in the electrical connector of the present invention. Each terminal 300 has an embed section 310, a contact section 320 and a mounting section 330. In this embodiment, the embed sections 310 of a portion of the terminals 300 are embedded in the front embed portion 116 of the fixing member 110 along the extension direction D2 via an insert-molding process while the embed sections 310 of the remaining portion of the terminals 300 are embedded in the rear embed portion 117 of the fixing member 110 along the extension direction D2 via the insert-molding process. The contact section 320 of each terminal extends from one end of the embed section 310 and is exposed to an exterior of the support seat 115 of said fixing member 110.

Alternately, the contact section 320 can extend in a direction perpendicular to the extension direction D2. After assembly (i.e. when the insulated body 210 is seated on the support seat 115 of the fixing member 110), the contact sections 320 of the terminals 300 pass through the terminal holes 214 in the insulated body 210 respectively and are retained within the plug reception chamber 215 of the insulated body 210 so as to make electrical connection with the inserted plug (not shown). Note that the bottom side 114 of the fixing member 110 permits passage of the extension holes 118.

Each of the terminals 300 further has a mounting section 330 extending from the other end of the embed section 310 and is exposed from the bottom side 114 of the fixing member 110 to an exterior after assembly. Each terminal employed in the electrical connector of the present invention is generally elongated as best shown in FIG. 5, which is fabricated by punching and bending a relatively long metal plate (not shown) without causing a large amount of metal waste, thereby economizing the metal waste when compared to the prior art manufacturing technology.

Each of the support members 400 has a coupling portion 410, an engaging portion 420 and a support portion 430. After assembly, the coupling portions 410 of the support members 400 extend respectively into two lateral sides of the insulated body 210, the engaging portions 420 thereof are engaged with the peripheral portion of the memory card (not shown) adjacent to the plug reception chamber 215 while the support portions 430 are connected to the printed circuit board (not shown).

For assembling the electrical connector of the present invention, the fixing member 110 is raised along the extension direction D2 so as to permit seating of the insulated body 210 on the support seat 115 so that the contact sections 320 of the terminals 300 extend through the terminal holes 214 respectively.

Figure 6:
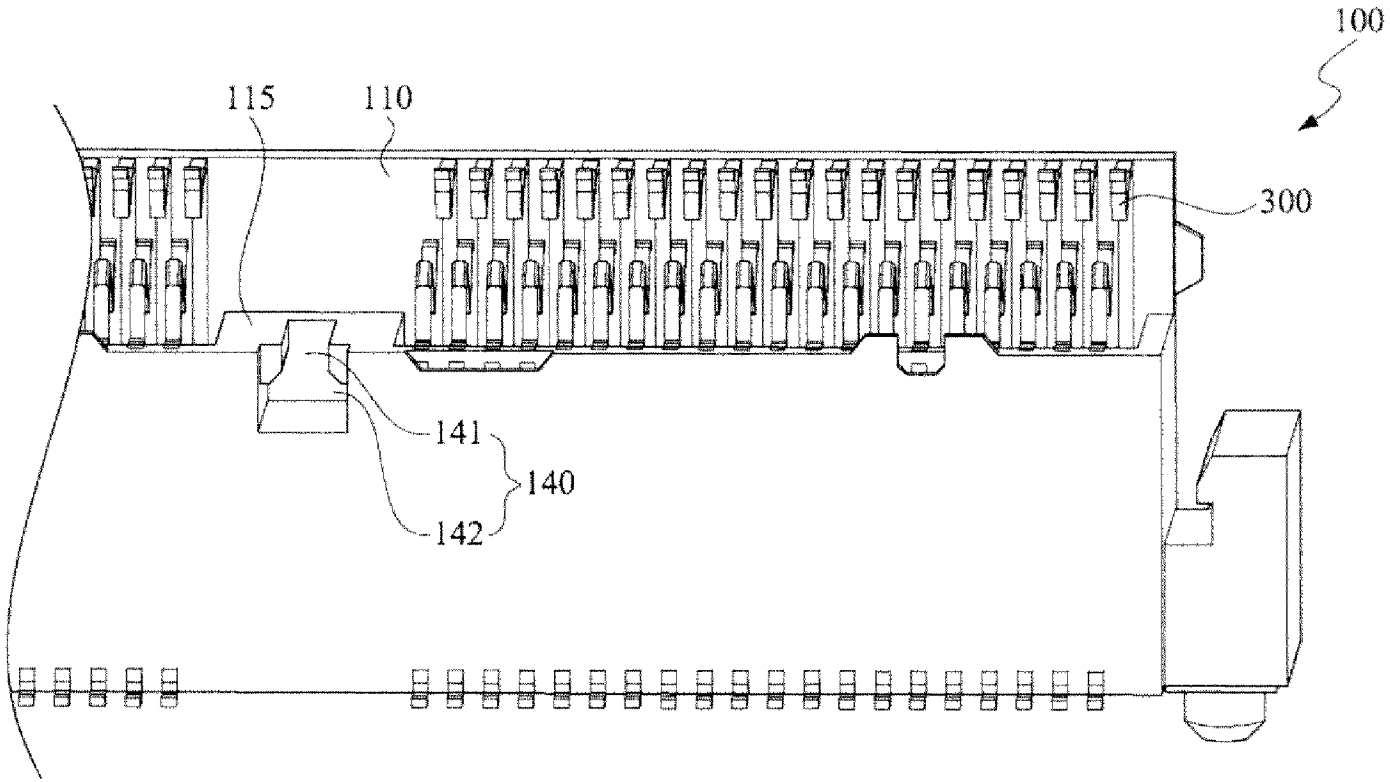
FIG. 6 is a partial perspective view of the fixing structure of the present invention.
Figure 7:
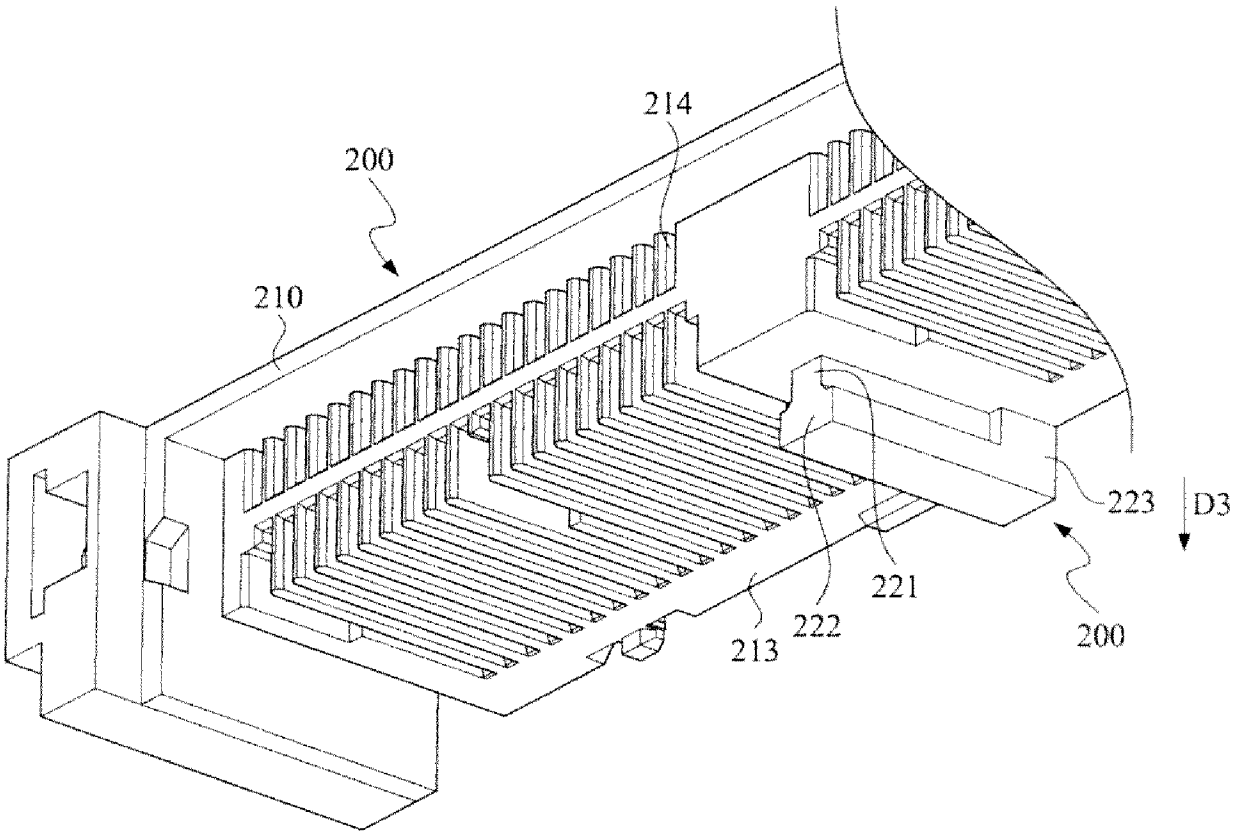
FIG. 7 is a partial perspective view of the coupling structure of the present invention.

Referring to FIGS. 6 and 7, wherein FIG. 6 is a partial perspective view of the fixing structure of the present invention and FIG. 7 is a partial perspective view of the coupling structure of the present invention. The fixing member 110 further including a T-shape guiding groove 140. The T-shape guiding groove 140 is formed on the support seat 115 of the fixing member 110 and extends along the coupling direction D1.

The T-shape guiding groove 140 further defines a narrow portion 141 and a width portion 142. The narrow portion 141 is formed at the support seat 115 and the width portion 142 is formed at the narrow portion 141. The width of the width portion 142 is wider then the narrow portion 141. The width portion 142 is corresponding to the width retaining portion 222 and the narrow portion 141 is corresponding to the narrow retaining portion 221.

The coupling structure 200 further includes a T-shape retaining element extending along the coupling direction D1. The T-shape retaining element 220 defines a narrow retaining portion 221, a width retaining portion 222 and a blocking portion 223. The narrow retaining portion 221 extends from the bottom of the insulated body 210 along the extension direction D3 and the width retaining portion 222 extends from the bottom of the narrow retaining portion 221 along the extension direction D3. The width of the width retaining portion 222 is wider then the narrow retaining portion 221. The blocking portion 223 extends from one end of the narrow retaining portion 221 to block the fixing member 110.

When the insulated body 210 is seated on the support seat 115 of the fixing member 110 along a coupling direction D1, the T-shape retaining element 220 is inserted into the T-shape guiding groove 140. Therefore, the insulated body 210 and the fixing member 110 are combined tightly.

Figure 8:
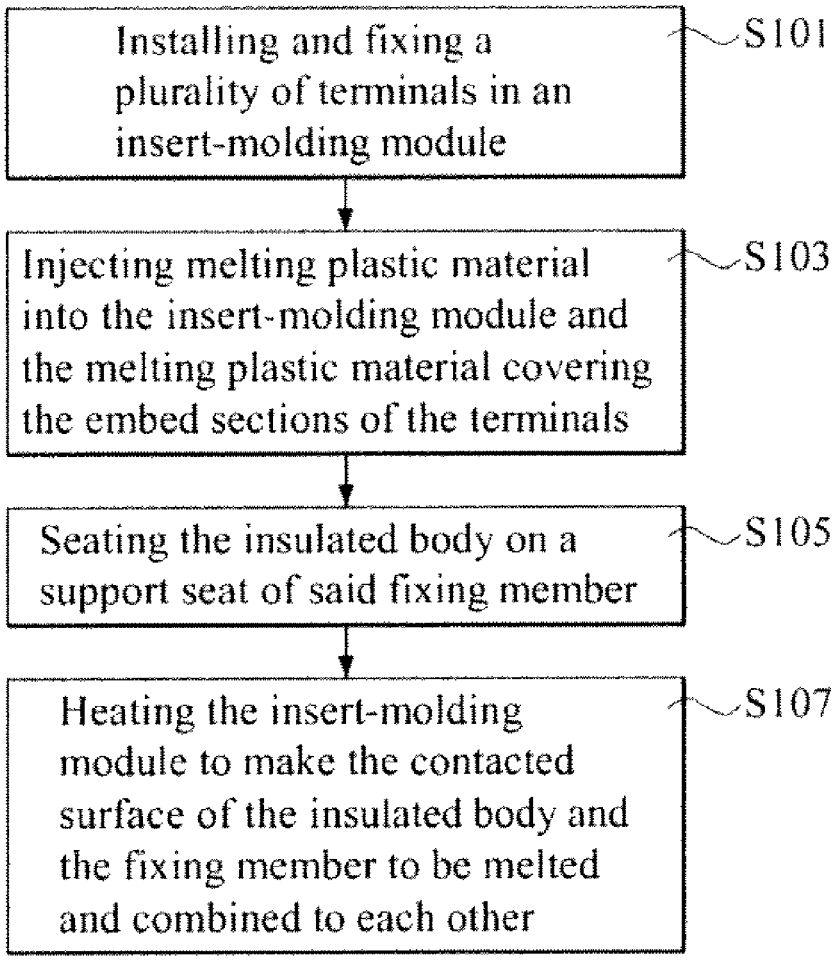
FIG. 8 is a flow chart of the manufacturing method of an electrical connector of the present invention.

FIG. 8 is a flow chart of the manufacturing method of an electrical connector of the present invention. The steps are described as follows.

First, an automatic equipment installs and fixes the terminals 300 in an insert-molding module (Step 101). Since the automatic equipment and insert-molding module are well known in prior art, detailed description of the same is omitted herein for the sake of brevity.

The automatic equipment injects melting plastic material into the insert-molding module to form the fixing structure 100. The melting plastic material flows into and cover the embed sections 310 of the terminals 300 in the insert-molding module (Step 103).

After a predetermine time and before the plastic material is not completely solidified, the automatic equipment seats the insulated body 210 on a support seat 115 of the fixing member 100 and makes the contact sections 320 of the terminals 300 pass through the terminal holes 214 in the insulated body 210 into a plug reception chamber 215 of the insulated body 210, where the surface of the insulated body 210 and the fixing member 100 contact each other (step 105).

Finally, the automatic equipment heats the insert-molding module to melt the contacted surface of the insulated body and the fixing member and combines relative to each other (step 107). Therefore, the fixing structure 100 and the insulated body 210 are combined tightly or are formed integrally (formed as an integral piece).

As explained above, the embed sections 310 of the terminals 300 are embedded within the fixing member 110 via the insert-molding process such that the contact section 320 thereof extend through the terminal holes 214 and are retained within the plug reception chamber 215. No other auxiliary fixing structure is required to maintain the position of the terminals 300. The terminals of the present invention can be fabricated from an elongated metal plate by punching and bending operation without causing a relatively large waste. In addition, since the embed sections of the terminals are embedded securely within the fixing member, the terminals are prevented from being pulled out easily from the electrical connector of the present invention. Since only minor portions of the terminals are exposed to the exterior of the insulated body, the occurrence of oxidation problem and electromagnetic interference among the exposed section as encountered during use of the conventional electrical connector can be avoided.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A manufacturing method of an electrical connector comprising the following steps:

(a) installing and fixing a plurality of terminals in an insert-molding module;

(b) injecting melting plastic material into the insert-molding module to form a fixing structure and the melting plastic material covering the embed sections of the terminals;

(c) after a predetermine time and before the plastic material being not completely solidified, seating the insulated body on a support seat of the fixing member to melt the contacted surface of the insulated body and the fixing member to combine relative to each other.

2. The manufacturing method according to claim 1, in the step (c) further including seating the insulated body on the support seat of the fixing member and make contact sections of the terminals pass through the terminal holes of the insulated body into a plug reception chamber of the insulated body.

3. The manufacturing method according to claim 1, in the step (c) further including seating the insulated body on the support seat of the fixing member and heating the insert-molding module to melt the contacted surface of the insulated body and the fixing member to combine relative to each other.

* * * * *